United States Patent [19]

Betts et al.

[11] Patent Number: 4,542,695

[45] Date of Patent: Sep. 24, 1985

[54] CONTOURED CONFIGURED DETONATING CORD AND DETONATOR

[75] Inventors: Robert E. Betts; John F. Crawford; Jacqueline C. Meador, all of Huntsville, Ala.

[73] Assignee: The United States of America as represented by the Secretary of the Army, Washington, D.C.

[21] Appl. No.: 478,385

[22] Filed: Mar. 24, 1983

[51] Int. Cl.[4] ..... F42B 15/10

[52] U.S. Cl. ..... 102/378; 102/275.1

[58] Field of Search ..... 102/377, 378, 306–310, 102/275–275.12, 202.7, 202; 89/1 A

[56] References Cited

U.S. PATENT DOCUMENTS

| | | | |
|---|---|---|---|
| 2,587,694 | 3/1952 | Chalmers et al. | 102/275.4 |
| 2,937,595 | 5/1960 | Margulis et al. | 102/378 X |
| 3,319,520 | 5/1967 | Stefano et al. | 102/378 X |
| 3,357,356 | 12/1967 | Bischoff | 102/378 |
| 4,220,088 | 9/1980 | Kimura et al. | 102/202.7 |
| 4,354,433 | 10/1982 | Owen | 102/378 X |

FOREIGN PATENT DOCUMENTS

| | | | |
|---|---|---|---|
| 371347 | 9/1963 | Switzerland | 102/378 |

*Primary Examiner*—Harold J. Tudor

*Attorney, Agent, or Firm*—Anthony T. Lane; Robert P. Gibson; Harold W. Hilton

[57] ABSTRACT

A contoured configured detonating cord and detonator is incorporated into a member during manufacture thereof. The member may be a rocket motor which is disposed to be broken into small fragments over inhabited areas subsequent to separation of the motor from the warhead. Separation permits the warhead to fly to the target without excessive drag and fragmenting the motor prevents large pieces from falling on the inhabitants. The detonating cord is contoured to the configuration of the motor to prevent stress risers from occurring and thereby weakening the motor structure.

1 Claim, 5 Drawing Figures

CONTOURED CONFIGURED DETONATING CORD AND DETONATOR

DEDICATORY CLAUSE

The invention described herein may be manufactured, used, and licensed by or for the Government for governmental purposes without the payment to us of any royalties thereon.

BACKGROUND OF THE INVENTION

In some cases it becomes necessary to fly rockets over inhabited areas to deliver a warhead to a target. Typically, the rocket motor is required to be separated from the forward portion of the rocket including the warhead to prevent excessive drag on the warhead in its flight to impact with the target. The falling mass may be hazardous to inhabitants or friendly troops over which the rocket must fly in its trajectory to a target.

It is therefore an object of the present invention to provide an apparatus for detonation of a rocket motor over inhabited areas so that the motor will break up into small pieces which will not present a falling hazard to people of the area.

It is a further object of the present invention to provide such explosive apparatus with a configuration which will provide for light weight and high strength construction of the motor casing or other structure in which the explosive apparatus is incorporated.

SUMMARY OF THE INVENTION

A mild detonating fuze and detonator therefore is disposed for incorporation in a wrapped pressure vessel, such as a rocket motor, for providing a cutting action to the casing of the pressure vessel for cutting the vessel to pieces. The mild detonating fuze and detonator is contoured to the diametrical shape of the pressure vessel and is incorporated in the wrappings of the vessel to prevent stress risers from occuring in the wrappings during manufacture of the pressure vessels.

DESCRIPTION OF THE PREFERRED EMBODIMENT

Figure 1:
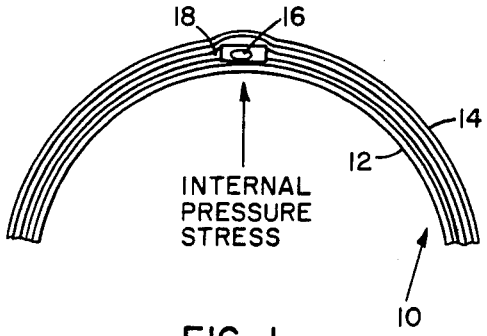
FIG. 1 is a cross-sectional view of a rocket motor having a typical mild detonating fuze therein.

As seen in FIG. 1, a rocket motor 10 is comprised of a plurality of inner and outer wraps 12 and 14, respectively. The wrap filaments is such as glass, carbon, kevlar or boron in a matrix such as epoxy. A typical mild detonating fuze 16 (FIG. 1) is shown incorporated in the wrap filaments. In FIG. 1 the fuze 16 is illustrated as being rectangular in cross-section. As can be seen, a space 18 occurs at the sides of the mild detonating fuze 16 during wrapping of the filaments during manufacture of the motor. Such construction allows stress risers to occur. Such stress rises weaken the motor casing and, responsive to pressure build-up in the motor during flight could lead to premature break-up of the rocket prior to warhead separation.

The mild detonating fuze and detonator of the present invention is configured to prevent the presence of stress risers.

Figure 2:
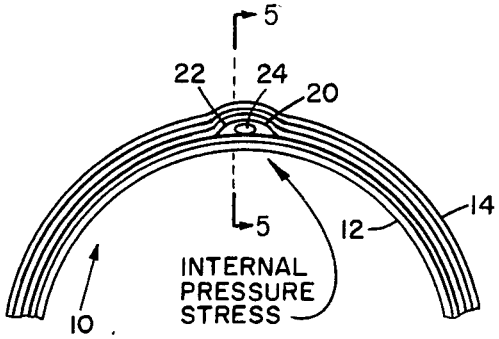
FIG. 2 is a cross-sectional view of a rocket motor having a contoured mild detonating fuze of the present invention incorporated therein.
Figure 3:
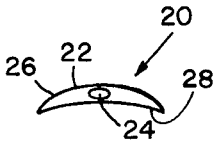
FIG. 3 is an enlarged cross-sectional view of the mild detonating fuze of the present invention.

As seen in FIGS. 2 and 3 applicants' mild detonating fuze 20 includes a sheath 22 and an explosive 24 enclosed by the sheath. Sheath 22 is provided with curved top and bottom intersecting surfaces 26 and 28 respectively (FIG. 3). The top surface having a smaller radius of curvature than the bottom surface to provide the mild detonating fuze with a contour that substantially matches that of the cylindrical shape of the rocket motor. As can be seen in FIG. 2 the detonating assembly is embedded in the motor casing in longitudinal relation therewith. Thus, the perturbations that occur as in FIG. 1, are eliminated resulting in the elimination of stress risers and less wraps of filament is necessary.

In the mild detonating fuze the explosive may be PETN or RDX and the sheath typically may be lead. However, aluminum, silver or copper may be resorted to in certain applications.

The detonator typically includes a bridgewire having a coating of lead azide thereon and a small booster charge of PETN.

Figure 5:
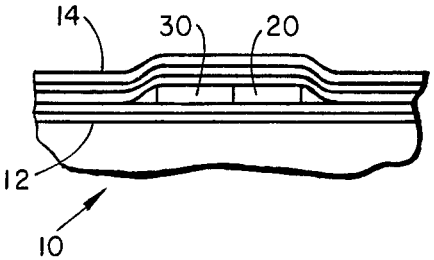
FIG. 5 illustrates the detonator of FIG. 4 in end to end abutting relationship with the detonating fuze.
Figure 4:
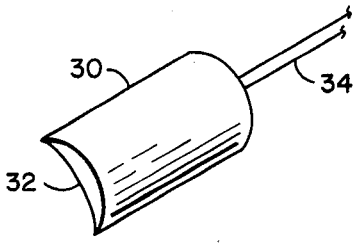
FIG. 4 is a pictorial view of the detonator for the mild detonating fuze of the present invention.

As seen in FIG. 4 the detonator 30 for detonating fuze 20 is also contoured to the shape of the motor. As seen in FIG. 4 the detonator is provided with a contour identical to that of the fuze illustrated in FIG. 3. The detonator is placed end to end abutting with fuze 20 (FIG. 5), or, if desired, the detonator 30 may have an indentation at the bottom 32 to receive the upper end of fuze 20 therein. Electrical leads 34 are provided for connecting to a source of electrical energy.

While the explosive structure has been described herein as incorporated in a rocket motor case such description should not limit the inventive concept thereto. Obviously, the explosive structure may be incorporated in composite structures such as aircraft bodies and space vehicles and associated components.

We claim:

1. In a rocket having a cylindrical motor casing disposed for detonation during flight thereof, a detonation assembly embedded longitudinally in the cylindrical motor casing of said rocket comprising:

a. a detonating fuze including a sheath enclosing an explosive, said sheath having curved top and bottom intersecting surfaces and said top surface having a smaller radius of curvature than the bottom surface, so that the contour of the fuze and cylindrical motor is similar; and, b. a detonator embedded in said motor in abutting end to end relationship with said fuze, said detonator including an explosive charge and a bridgewire for ignition thereof, said detonator having curved top and bottom intersecting surfaces, said top surface having a smaller radius of curvature than the bottom surface, so that the contour of the detonator and cylindrical motor are similar, said detonator disposed for detonating said fuze embedded in said motor whereby said motor is broken into fragments responsive to detonation by said fuze.

* * * * *